US011707941B2

(12) United States Patent
Uchibori

(10) Patent No.: US 11,707,941 B2
(45) Date of Patent: Jul. 25, 2023

(54) POST-PROCESSING APPARATUS

(71) Applicant: Seiko Epson Corporation, Tokyo (JP)

(72) Inventor: Kenji Uchibori, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/653,071

(22) Filed: Mar. 1, 2022

(65) Prior Publication Data

US 2022/0281252 A1 Sep. 8, 2022

(30) Foreign Application Priority Data

Mar. 4, 2021 (JP) ..... 2021-034805

(51) Int. Cl.
*B65H 37/04* (2006.01)
*B41L 43/12* (2006.01)
*B41J 29/377* (2006.01)

(52) U.S. Cl.
CPC ..... *B41L 43/12* (2013.01); *B41J 29/377* (2013.01)

(58) Field of Classification Search
CPC ..... B41L 43/12; B65H 37/04; B65H 31/20; B65H 31/26; B65H 31/32; B65H 31/34; B65H 9/10; B65H 2301/362; B65H 2301/363; B65H 2408/114; H04N 1/0066
USPC ..... 270/58.08, 58.12, 58.17, 58.27
See application file for complete search history.

(56) References Cited

U.S. PATENT DOCUMENTS 7,510,177 B2 * 3/2009 Nagata ..... B65H 29/14 270/58.08
8,104,758 B2 * 1/2012 Tanaka ..... B65H 31/34 270/58.11
8,123,209 B2 * 2/2012 Kubota ..... G03G 15/6541 270/58.08

(Continued)

FOREIGN PATENT DOCUMENTS

JP 2015-030602 2/2015
JP 2015168142 A * 9/2015 ..... B42C 1/12
JP 2020090375 A * 6/2020

OTHER PUBLICATIONS

Espacenet machine translation of JP2020090375A; http://translationportal.epo.org/emtp/translate/?ACTION=description-retrieval&COUNTRY=JP&ENGINE=google&FORMAT=docdb&KIND=A&LOCALE=en_EP&NUMBER=2020090375&OPS=ops.epo.org/3.2&SRCLANG=ja&TRGLANG=en (Year: 2020).*

*Primary Examiner* — Leslie A Nicholson, III
(74) *Attorney, Agent, or Firm* — Workman Nydegger

(57) ABSTRACT

A post-processing apparatus includes a first discharge section configured to discharge a medium having thereon information recorded by a recording section, a processing tray configured to be loaded with the medium discharged by the first discharge section, an edge alignment section disposed on the processing tray, a transport section making contact with an upper surface of the medium mounted on the processing tray and configured to transport the medium to the edge alignment section, a position change section configured to change a relative position of the transport section with respect to the processing tray, and a controller configured to change pressure of when the transport section presses the medium by controlling the position change section, and a post-processing section configured to perform post-processing on the medium on the processing tray, (Continued)

wherein the controller changes the pressure based on processing information regarding processing to be performed on the medium.

13 Claims, 7 Drawing Sheets

(56) References Cited

U.S. PATENT DOCUMENTS

| | | | | |
|---|---|---|---|---|
| 8,136,812 | B2 * | 3/2012 | Yamashita | B42C 1/12 270/58.08 |
| 8,162,305 | B2 * | 4/2012 | Hattori | B65H 39/10 270/58.08 |
| 8,172,214 | B2 * | 5/2012 | Kubota | B65H 31/34 270/58.11 |
| 10,530,951 | B2 * | 1/2020 | Miyauchi | H04N 1/0066 |
| 2015/0035226 | A1 | 2/2015 | Nishi et al. | |

* cited by examiner

POST-PROCESSING APPARATUS

The present application is based on, and claims priority from JP Application Serial No. 2021-034805, filed Mar. 4, 2021, the disclosure of which is hereby incorporated by reference herein in its entirety.

BACKGROUND

1. Technical Field

The present disclosure relates to a post-processing apparatus.

2. Related Art

Post-processing apparatuses that perform post-processing on a sheet, which is an example of a medium on which an image is formed, are on the market. Examples of such apparatuses include JP-A-2015-30602. A post-processing apparatus includes a processing tray on which sheets are piled up, a transport section that transports a sheet on the processing tray, and a trailing edge regulation member, which is an example of an edge alignment section. The transport section aligns a sheet by causing the sheet to strike against the trailing edge regulation member.

The transport section disclosed in JP-A-2015-30602 sometimes presses a sheet with high pressure when the transport section makes contact with the upper surface of the sheet. In this case, the transport section might damage an image on the sheet depending on the condition of the sheet.

SUMMARY

According to an aspect of the present disclosure, there is provided a post-processing apparatus including: a discharge section configured to discharge a medium having thereon information recorded by a recording section, the recording section recording the information by discharging liquid; a processing tray configured to be loaded with the medium discharged by the discharge section; an edge alignment section disposed on the processing tray and configured to align an edge of the medium; a transport section having contact with an upper surface of the medium mounted on the processing tray and configured to transport the medium to the edge alignment section; a position change section configured to change a relative position of the transport section with respect to the processing tray; a controller configured to change pressure of when the transport section makes contact with the medium by controlling the position change section; and a post-processing section configured to perform post-processing on the medium on the processing tray, wherein the controller changes the pressure based on processing information regarding processing to be performed on the medium.

DESCRIPTION OF EXEMPLARY EMBODIMENTS

First Embodiment

Recording System

In the following, a description will be given of a recording system including a post-processing apparatus according to a first embodiment.

Figure 1:
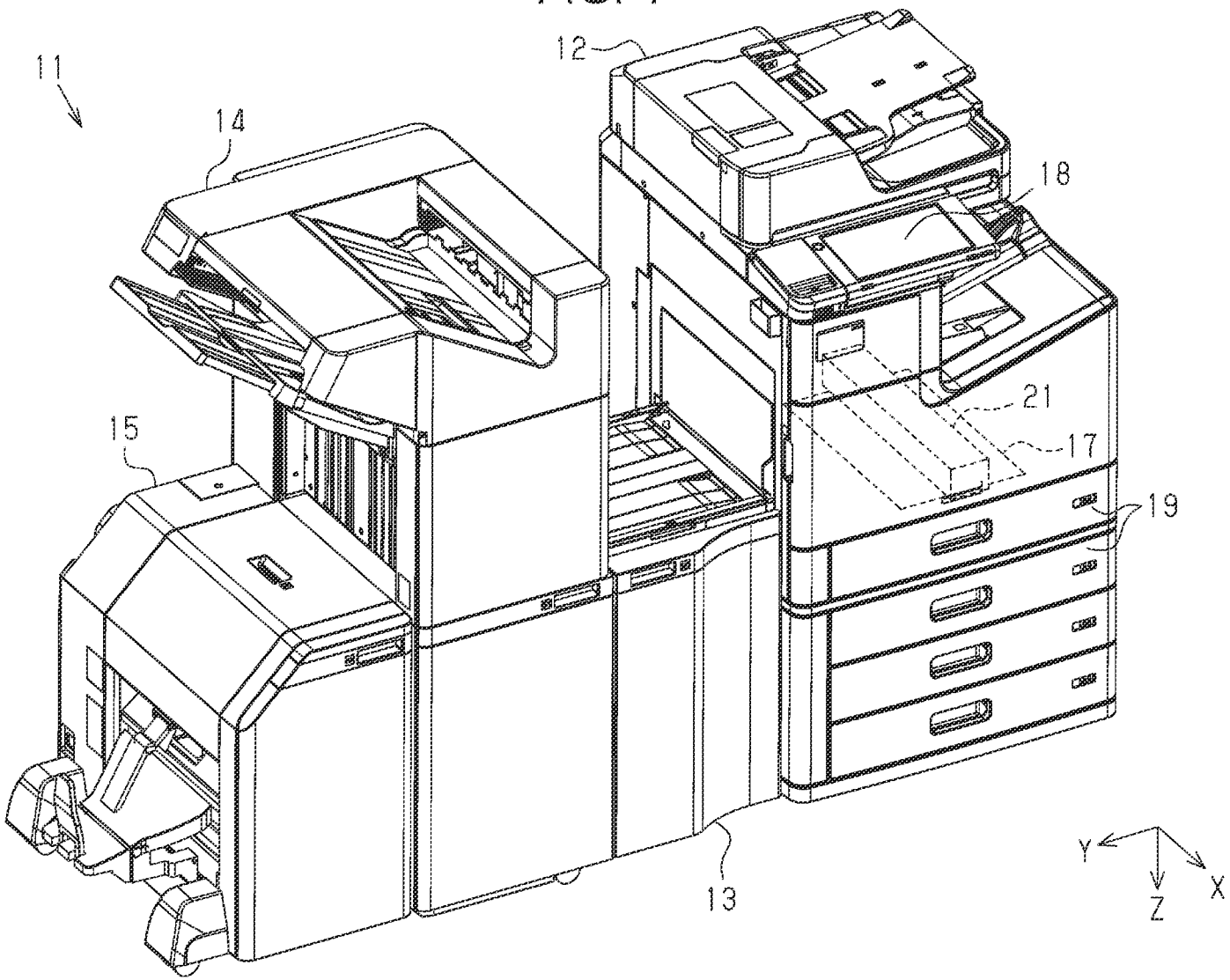
FIG. 1 is a perspective view of a recording system including a post-processing apparatus according to a first embodiment.

In FIG. 1, it is assumed that a recording system 11 is placed on a horizontal plane. A gravity direction is denoted by Z-axis, and directions along the horizontal plane are denoted by X-axis and Y-axis. X-axis, Y-axis, and Z-axis are perpendicular to each other. In the following description, a direction parallel to X-axis is referred to as a width direction X, a direction parallel to Y-axis is referred to as a transport direction Y, and a direction parallel to Z-axis is referred to as a vertical direction Z.

As illustrated in FIG. 1, the recording system 11 includes a recording apparatus 12, an intermediate apparatus 13, a post-processing apparatus 14, and a folding apparatus 15, which are disposed alongside in the transport direction Y. The recording apparatus 12, the intermediate apparatus 13, the post-processing apparatus 14, and the folding apparatus 15 are disposed adjacently to one another.

The recording apparatus 12 is an ink jet method printer that records an image, for example, by discharging ink, which is an example of liquid, on a medium 17. An image is formed by liquid being attached to the medium 17. An image includes a photograph, a pattern, a character, a sign, a mark, a line, a table, and the like.

The recording apparatus 12 may include an operation section 18, for example, a touch panel or the like for operating the recording apparatus 12 and the recording system 11, and a medium accommodation section 19 that is able to accommodate the mediums 17 in a laminated state. The recording apparatus 12 may include a plurality of medium accommodation sections 19.

The recording apparatus 12 includes a recording section 21 that performs recording by discharging liquid. The recording section 21 performs recording on the medium 17 that is sent from the medium accommodation section 19 one by one. The recording section 21 according to the present embodiment is a line type device that is disposed in the width direction X of the medium 17. The recording section 21 may be a serial type device that performs recording while moving in the width direction X of the medium 17.

It is possible for the recording apparatus 12 to perform both single-sided recording in which recording is performed on only one side of the medium 17 and double-sided recording in which recording is performed on both sides of the medium 17. When single-sided recording is performed, the recording apparatus 12 performs recording on the front face of the medium 17, and then sends the medium 17 to the intermediate apparatus 13. When double-sided recording is performed, the recording apparatus 12 performs recording on the front face of the medium 17, and then inverts the medium 17 and returns the medium to the recording section 21, and performs recording on the back side of the medium 17. The recording apparatus 12 sends the double-sided recorded medium 17 to the intermediate apparatus 13.

The intermediate apparatus 13 sends a single-sided or double-sided recorded medium 17 to the post-processing apparatus 14. When folding processing is performed on the recorded medium 17, the post-processing apparatus 14 sends the medium 17 to the folding apparatus 15. The folding apparatus 15 may perform binding processing for binding the middle of the mediums 17 with a staple.

Post-Processing Apparatus

Figure 2:
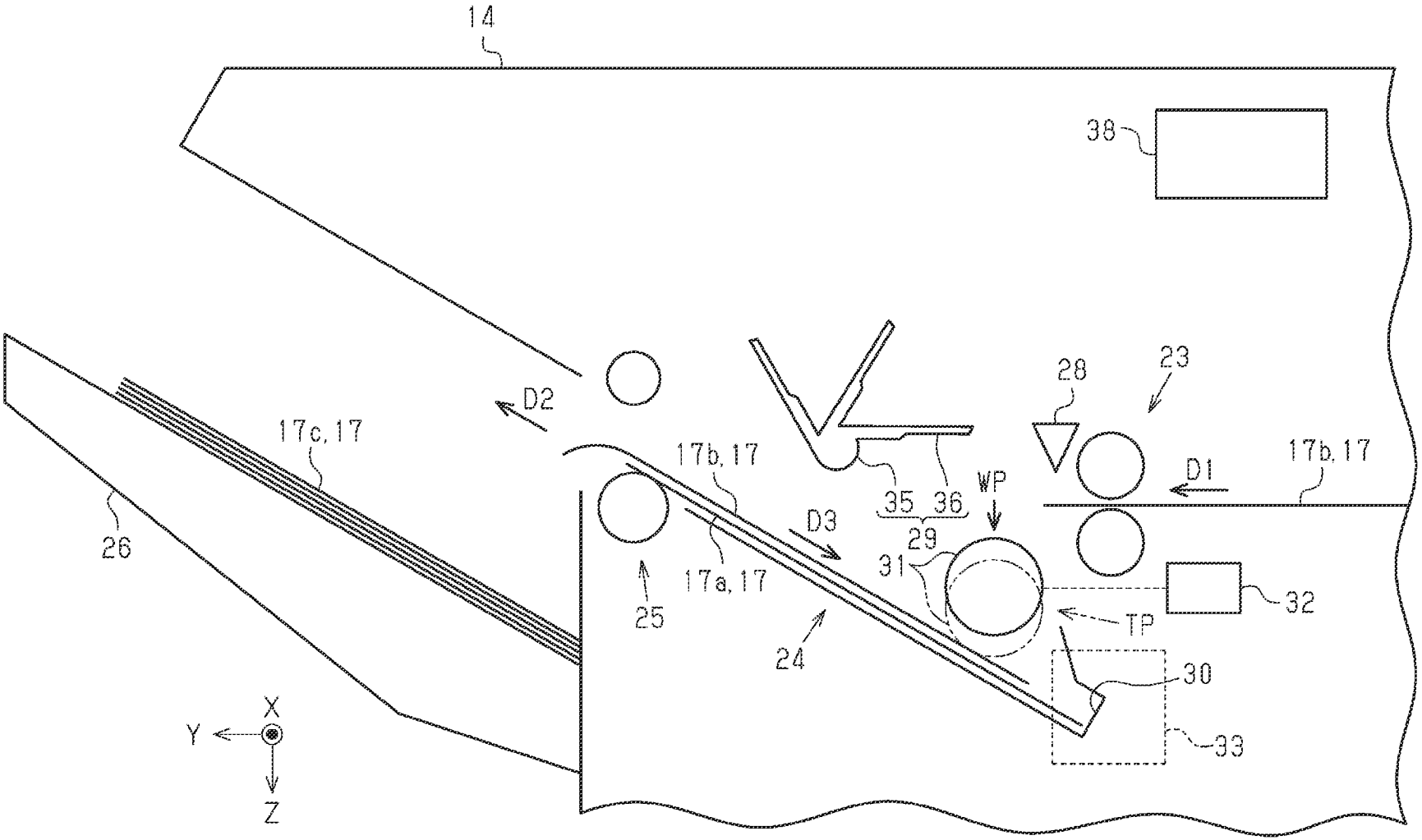
FIG. 2 is a schematic diagram of the post-processing apparatus.

As illustrated in FIG. 2, the post-processing apparatus 14 includes a first discharge section 23, which is an example of the discharge section that discharges the medium 17 on which information is recorded by the recording section 21, and a processing tray 24 on which the medium 17 discharged by the first discharge section 23 is loaded. The post-processing apparatus 14 may include a second discharge section 25 that discharges the medium 17 loaded on the processing tray 24, and a loading tray 26 on which the medium 17 discharged by the second discharge section 25 is loaded.

The first discharge section 23 and the second discharge section 25 may individually include a pair of rollers. The first discharge section 23 and the second discharge section 25 discharge the medium 17 by being rotated while the medium 17 is sandwiched therebetween, respectively.

In the present embodiment, the aligned medium 17 mounted on the processing tray 24 is referred to as a first medium 17*a*, the unaligned medium 17 to be discharged by the first discharge section 23 is referred to as a second medium 17*b*, the medium 17 mounted on the loading tray 26 is referred to as a third medium 17*c*. The first discharge section 23 discharges the second medium 17*b* in a first discharge direction D1. The second discharge section 25 discharges the first medium 17*a* in a second discharge direction D2.

The processing tray 24 is disposed downstream of the first discharge section 23 in the first discharge direction D1 and at least has a part positioned lower than the first discharge section 23 in the vertical direction Z. Accordingly, the processing tray 24 receives the second medium 17*b* that is discharged by the first discharge section 23 and falls. The second medium 17*b* is aligned on the processing tray 24 so as to become the first medium 17*a*. That is to say, the second medium 17*b* discharged from the first discharge section 23 is loaded and aligned on the processing tray 24 so as to be regarded as the first medium 17*a*.

The loading tray 26 is disposed downstream of the second discharge section 25 in the second discharge direction D2 and at least has a part positioned lower than the second discharge section 25 in the vertical direction Z. Accordingly, the loading tray 26 receives the first medium 17*a* that is discharged by the second discharge section 25 and falls. The first medium 17*a* is loaded on the loading tray 26 so as to be regarded as the third medium 17*c*.

The post-processing apparatus 14 may include a detection section 28 which is detectable of the second medium 17*b*, and a paddle 29 disposed downstream of the first discharge section 23 in the first discharge direction D1. The post-processing apparatus 14 includes an edge alignment section 30 disposed on the processing tray 24, and a transport section 31 that transports the medium 17 to the edge alignment section 30. The post-processing apparatus 14 includes a position change section 32 that changes the relative position of the transport section 31 with respect to the processing tray 24, and a post-processing section 33 that performs post-processing on the medium 17 on the processing tray 24.

The paddle 29 is positioned above the processing tray 24. The paddle 29 includes a rotational shaft 35 and at least one blade 36. The paddle 29 according to the present embodiment includes three blades 36. The blades 36 are, for example, elastic plate-shaped members. The blades 36 are rotated integrally with the rotational shaft 35.

The transport section 31 may include, for example, a knurled belt. The knurled belt is a belt having unevenness formed on its front surface and having a higher friction force with the contacted opponent member compared with a belt having a flat front surface.

The position change section 32 moves at least one of the processing tray 24 and the transport section 31. The position change section 32 according to the present embodiment moves the transport section 31 between a waiting position WP denoted by a solid line illustrated in FIG. 2 and a transport position TP denoted by a dash-double-dot line.

The waiting position WP is a position at which the transport section 31 leaves the processing tray 24, the first medium 17*a* loaded on the processing tray 24, and the second medium 17*b* sent by the paddle 29. The transport position TP is a position at which the transport section 31 makes contact with the second medium 17*b*. The transport section 31 positioned at the transport position TP sandwiches the first medium 17*a* and the second medium 17*b* between the processing tray 24 and the transport section 31. When the first medium 17*a* is not loaded on the processing tray 24, the transport section 31 sandwiches the second medium 17*b* between the processing tray 24 and the transport section 31. Accordingly, the transport position TP is changed in accordance with the thickness of the medium 17 on the processing tray 24.

The transport section 31 positioned at the transport position TP is rotated in the counterclockwise direction in FIG. 2 so as to transport the second medium 17*b* in the alignment direction D3. The alignment direction D3 is a direction parallel to a face of the processing tray 24 on which the first medium 17*a* is loaded. The edge alignment section 30 is positioned at a downstream end of the processing tray 24 in the alignment direction D3. The transport section 31 aligns the second medium 17*b* by causing the second medium 17*b* to strike against the edge alignment section 30.

In other words, the edge alignment section 30 aligns the edge of the second medium 17*b* transported by the transport section 31. The alignment according to the present embodiment is to match the downstream end of the second medium 17*b* in the alignment direction D3 with the edge alignment section 30. When the first medium 17*a* is mounted on the processing tray 24, the edge of the first medium 17*a* and the edge of the second medium 17*b* are aligned by aligning the second medium 17*b*. The second medium 17*b* is regarded as the first medium 17*a* by being aligned so that a plurality of first mediums 17*a* are piled up on the processing tray 24 with the downstream ends aligned in the alignment direction D3.

The post-processing apparatus 14 according to the present embodiment performs staple processing on the first medium 17*a*. The staple processing is processing for binding a plurality of sheets of the first medium 17*a* with a staple. The post-processing apparatus 14 may perform punch processing, shift processing, and the like. The punch processing is processing for punching one or a plurality of sheets of the first medium 17*a*. The shift processing is processing for discharging the first medium 17*a* in units of copy on the loading tray 26 with shifting the position for each copy.

The post-processing apparatus 14 includes a controller 38. The controller 38 may integrally control driving of each mechanism in the post-processing apparatus 14 and may control various operations executed by the post-processing apparatus 14. The controller 38 may be constituted by α: one or more processors that perform various kinds of processing in accordance with a computer program, β: one or more dedicated hardware circuits, such as an application-specific integrated circuit or the like that performs at least one of processing out of various kinds of processing, or γ: a circuit including the combination of thereof. The processor includes a CPU, a memory, such as a RAM, a ROM, or the like, and the memory stores program code or a command so as to cause the CPU to perform processing. The memory, that is to say, a computer readable medium includes all the readable mediums to be accessed by a general or dedicated computer.

Pressure to Press Second Medium

The controller 38 controls the position change section 32 so that the transport section 31 changes the pressing pressure on the medium 17. For example, the controller 38 may change the pressure to press the transport section 31 by changing the power transmission time for the position change section 32 to transmit power to the transport section 31. Specifically, when the position change section 32 transmits power to the transport section 31 located at the waiting position WP, the transport section 31 moves to the transport position TP to make contact with the second medium 17*b*, and the movement thereof is restricted. Thus, when the transport section 31 located at the transport position TP is further pressed to the processing tray 24, the pressure that the transport section 31 presses the second medium 17*b* becomes high. Accordingly, when the number of sheets and the type of the first medium 17*a* loaded on the processing tray 24 are the same, by prolonging the power transmission time for the position change section 32 to transmit power to the transport section 31, it is possible to increase the pressing pressure on the first medium 17*a* and the second medium 17*b* compared with the case in which the power transmission time is short.

The controller 38 changes the pressing pressure on the medium 17 based on the processing information regarding processing to be performed on the medium 17. The processing information may include a transport time from when the recording section 21 records information on the second medium 17*b* to when the first discharge section 23 discharges the second medium 17*b*. The transport time is a time period required from the end of recording on the second medium 17*b* to the transport processing for transporting the second medium 17*b* to the first discharge section 23. The transport section 31 presses the second medium 17*b* with the pressure based on the transport time so as to align the second medium 17*b*.

Alignment Routine of First Embodiment

Next, a description will be given of an alignment routine with reference to a flowchart illustrated in FIG. 3. The alignment routine is executed when an instruction of recording with post-processing is input.

Figure 3:
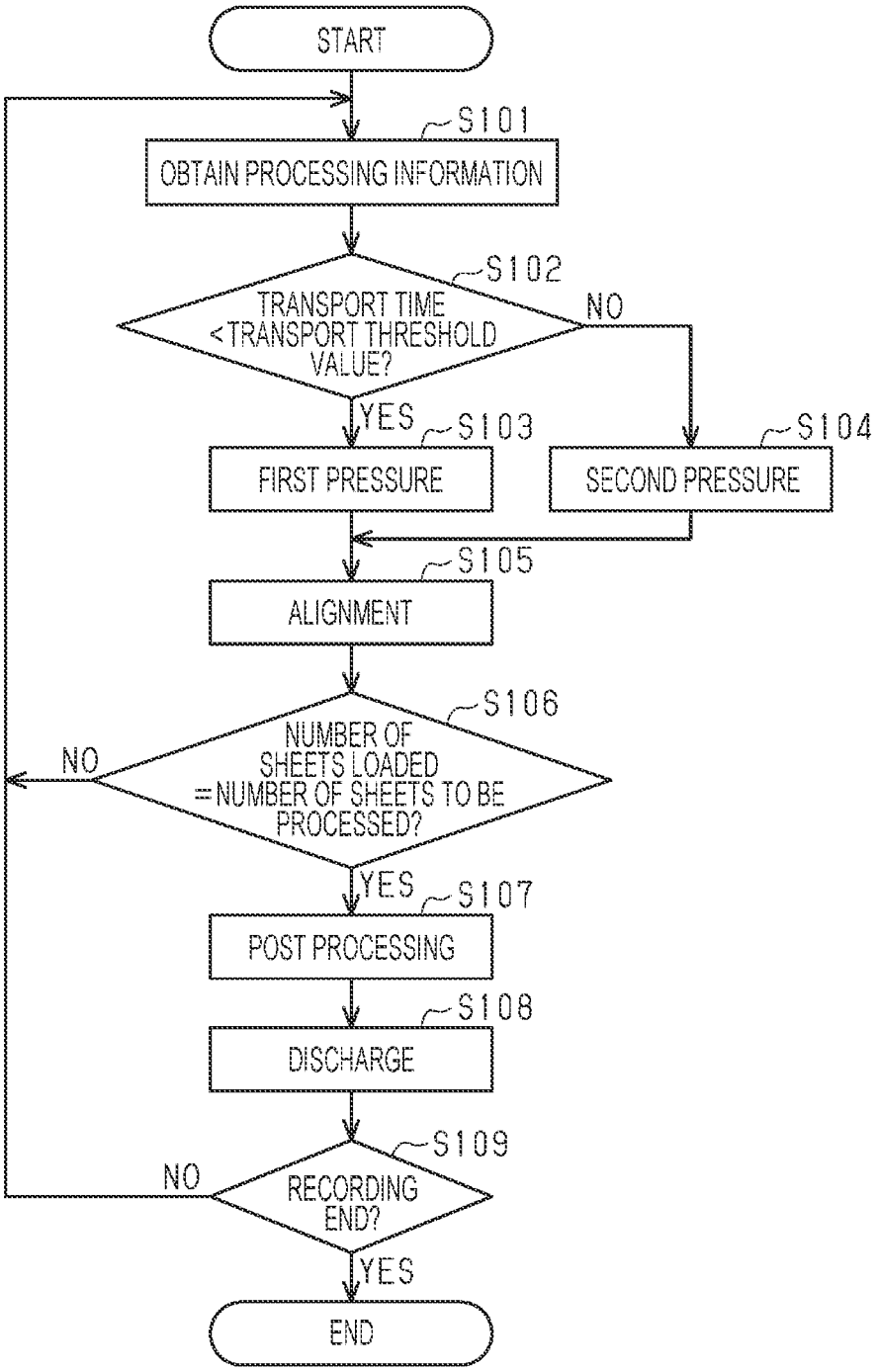
FIG. 3 is a flowchart illustrating an alignment routine according to a first embodiment.

As illustrated in FIG. 3, in step S101, the controller 38 obtains processing information. That is to say, the controller 38 obtains the transport time included in the processing information. In step S102, the controller 38 compares the transport time with the transport threshold value. The transport threshold value is set from, for example, an experimental result or the like in advance. When the transport time is shorter than the transport threshold value, the processing proceeds to YES in step S102, and the processing proceeds to step S103. In step S103, the controller 38 moves the transport section 31 to the transport position TP, and sets the pressure that the transport section 31 presses the second medium 17*b* to a first pressure lower than a second pressure.

In step S102, when the transport time is equal to or longer than a transport threshold value, the processing proceeds to NO in step S102, and the processing of the controller 38 proceeds to step S104. In step S104, the controller 38 moves the transport section 31 to the transport position TP, and sets the pressure that the transport section 31 presses on the second medium 17*b* to a second pressure higher than the first pressure.

In step S105, the controller 38 aligns the second medium 17*b* by rotating the transport section 31. The second medium 17*b* is aligned to become the first medium 17*a*. In step S106, the controller 38 determines whether or not the number of sheets of the first medium 17*a* loaded on the processing tray 24 becomes the number of sheets to be processed, which is the number of sheets in a unit to perform the post-processing. When the number of sheets loaded is smaller than the number of sheets to be processed, the processing proceeds to NO in step S106, and the processing of the controller 38 proceeds to step S101. In step S101, the controller 38 obtains the transport time of the next second medium 17*b*.

When the number of sheets loaded becomes the number of sheets to be processed, the processing in step S106 becomes YES, the processing of the controller 38 proceeds to step S107. In step S107, the controller 38 causes the post-processing section 33 to perform the post-processing on a plurality of first mediums 17*a* on the processing tray 24. In step S108, the controller 38 discharges the plurality of first mediums 17*a* having been subjected to the post-processing from the processing tray 24 to the loading tray 26. Thereby, the number of sheets of the first mediums 17*a* loaded on the processing tray 24 becomes zero.

In step S109, the controller 38 determines whether or not the recording has ended. When there is a second medium 17*b* that is not discharged from the first discharge section 23, the processing of step S109 becomes NO, and the processing of the controller 38 proceeds to step S101. When all of the recorded mediums 17 are discharged to the loading tray 26, the processing of step S109 becomes YES, and the controller 38 ends the alignment routine.

Operation of First Embodiment

As illustrated in FIG. 2, while the first discharge section 23 is discharging the second medium 17*b*, the controller 38 may cause the paddle 29 to stop at the stop posture illustrated in FIG. 2. At this time, the controller 38 may locate the transport section 31 at the transport position TP. The transport section 31 located at the transport position TP sandwiches the first medium 17*a* between the processing tray 24 and the transport section 31. Accordingly, it is possible to reduce the risk of the aligned first medium 17*a* being disordered.

The blade 36 of the paddle 29 in the stop posture is located above the pair of rollers from which the first discharge section 23 discharges the second medium 17*b*. Accordingly, the second medium 17*b* discharged from the first discharge section 23 is put in between the blade 36 and the processing tray 24.

When the rear end of the second medium 17*b* in the first discharge direction D1 passes the first discharge section 23, the controller 38 moves the transport section 31 to the waiting position WP and rotates the paddle 29 in the counterclockwise direction in FIG. 2. For example, the controller 38 may determine that the second medium 17*b* has passed the first discharge section 23 when a change occurs from the state of detecting the second medium 17*b* by the detection section 28 to the state of not detecting. The rotating paddle 29 puts the second medium 17*b* between the transport section 31 located at the waiting position WP and the processing tray 24.

Next, the controller 38 controls the position change section 32 so as to move the transport section 31 to the transport position TP. The transport section 31 located at the transport position TP makes contact with the upper surface of the second medium 17*b* mounted on the processing tray 24. At this time, the controller 38 changes the pressure that the transport section 31 presses the second medium 17*b* based on the transport time. The transport time is a time period during which the recorded second medium 17*b* is transported, and is a time period during which the liquid attached with recording evaporates. That is to say, in the case of a short transport time, an image recorded on the second medium 17*b* is not dry compared with the case of a long transport time, and thus the image is easily damaged.

When the transport time is shorter than the transport threshold value, the controller 38 reduces the pressing pressure on the second medium 17*b* than when the transport time is equal to or higher than the transport threshold value. Specifically, when the transport time is shorter than the transport threshold value, the controller 38 sets the pressing pressure on the second medium 17*b* to the first pressure lower than the second pressure. When the transport time equal to or higher than the transport threshold value, the controller 38 sets the pressing pressure on the second medium 17*b* to the second pressure higher than the first pressure.

The controller 38 rotates the transport section 31 located at the transport position TP so as to align the second medium 17*b*. In the present embodiment, the medium 17 before alignment is referred to as a second medium 17*b*, and the aligned medium 17 is referred to as a first medium 17*a*. Accordingly, the aligned first medium 17*a* is loaded on the processing tray 24.

When the number of sheets loaded, which is the number of sheets of the first medium 17*a* loaded on the processing tray 24, is smaller than the number of sheets to be processed, which is the unit for performing post-processing, the controller 38 waits until the first discharge section 23 discharges the next second medium 17*b*.

When the number of sheets loaded becomes the number of sheets to be processed, the controller 38 causes the post-processing apparatus 14 to perform the post-processing. In the post-processing section 33 according to the present embodiment, a plurality of first mediums 17*a* loaded on the processing tray 24 are bound by a staple. The controller 38 controls the second discharge section 25 so as to discharge a bundle of the first mediums 17*a* on the processing tray 24 to the loading tray 26.

Advantages of First Embodiment

A description will be given of the advantages of the present embodiment.

1. The controller 38 changes the pressure that the transport section 31 presses the second medium 17*b* based on the processing information on the processing to be performed on the second medium 17*b*. Accordingly, it is possible for the transport section 31 to press the second medium 17*b* with the pressure matching the state of the second medium 17*b*, and thus it is possible to reduce the risk of damaging an image recorded on the second medium 17*b*.

2. Drying of an image recorded on the medium 17 progresses while the medium 17 is being transported. Thus, when the transport time is short, the second medium 17*b* is sometimes discharged from the first discharge section 23 with insufficient drying of the image. An insufficiently dried image is easy to be damaged compared with a sufficiently dried image. When the transport time is shorter than the transport threshold value, the controller 38 reduces the pressing pressure on the second medium 17*b* than in the case in which the transport time is equal to or higher than the transport threshold value. That is to say, it is possible for the post-processing apparatus 14 to press the second medium 17*b* with the pressure matching the dry state, and thus to reduce the risk of damaging the image recorded on the second medium 17*b*.

3. When the transport time is equal to or higher than the threshold time, drying of the image progresses more than the case in which the transport time is shorter than the threshold value, and thus the image is hard to be damaged. When the transport time is equal to or longer than the transport threshold value, the controller 38 sets the pressure that the transport section 31 presses the second medium 17*b* to the second pressure higher than the first pressure. Accordingly, when the transport time is equal to or longer than the threshold time, it is possible to efficiently transport the second medium 17*b*.

Second Embodiment

Next, a description will be given of the post-processing apparatus according to a second embodiment with reference to the drawings. The second embodiment has an alignment routine different from that of the first embodiment. The other components are almost the same as those of the first embodiment. Thus the same sign is given to the same component as that in the first embodiment, and duplicated description will be omitted.

The processing information according to the present embodiment includes a recording concentration in the recording processing performed by the recording section 21 on the medium 17. A recording concentration is the ratio of an image recording area to all the area of the medium 17. In other words, a recording concentration is the ratio of the number of ink dots actually impacted to the maximum number of ink dots able to impact the medium 17. The processing information may include the recording concentrations of the upper surface and the lower surface of each medium 17, or may include a value calculated from the recording concentrations.

The processing information according to the present embodiment includes the total value of a first recording concentration of the upper surface of the first medium 17*a* mounted on the processing tray 24 and a second recording concentration of the lower surface of the second medium 17*b* discharged by the first discharge section 23 on the processing tray 24 subsequently to the first medium 17*a*. When a plurality of first mediums 17*a* are mounted on the processing tray 24, the first recording concentration is the recording concentration of the upper surface of the first medium 17*a* located topmost. The processing information may include a third recording concentration of the upper surface of the second medium 17*b*.

As illustrated in FIG. 2, the second medium 17*b* is transported in the alignment direction D3 in the state in which the lower surface of the second medium 17*b* is in contact with the upper surface of the first medium 17*a*. Accordingly, when the total value of the first recording concentration and the second recording concentration is high, the second medium 17*b* is hard to slip with respect to the first medium 17*a* compared with the case in which the total value is low. The transport section 31 presses the upper surface of the second medium 17*b*, and thus when the third recording concentration is high, the upper surface of the second medium 17*b* is easy to be damaged compared with the case in which the third recording concentration is low.

Pressure to Press Second Medium

It is possible for the position change section 32 according to the present embodiment to change in multiple stages the pressure that the transport section 31 presses the second medium 17*b*. Specifically, it is possible for the transport section 31 to press the second medium 17*b* with a first pressure, a second pressure, a third pressure, and a fourth pressure. The first pressure is lower than the second pressure. The second pressure is higher than the first pressure and is lower than or equal to the third pressure. The third pressure is equal to or higher than the second pressure and lower than the fourth pressure. The fourth pressure is higher than the third pressure. That is to say, among the first pressure to fourth pressure, the first pressure is the lowest, and the fourth pressure is the highest.

Time to Align Second Medium

The controller 38 may rotate the transport section 31 to change the alignment time to transport the second medium 17*b*. It is possible for the controller 38 according to the present embodiment to set the alignment time to a first alignment time, a second alignment time, a third alignment time, and a fourth alignment time. The first alignment time is longer than the second alignment time. The second alignment time is shorter than the first alignment time and is equal to or longer than the third alignment time. The third alignment time is shorter than or equal to the second alignment time and longer than the fourth alignment time. The fourth alignment time is shorter than the third alignment time. That is to say, among the first transport time to the fourth alignment time, the first alignment time is the longest, and the fourth alignment time is the shortest. The second alignment time and the third alignment time may have the same time length.

Alignment Routine of Second Embodiment

Next, a description will be given of the alignment routine with reference to a flowchart illustrated in FIG. 4. The alignment routine is executed when an instruction of recording with post-processing is input.

Figure 4:
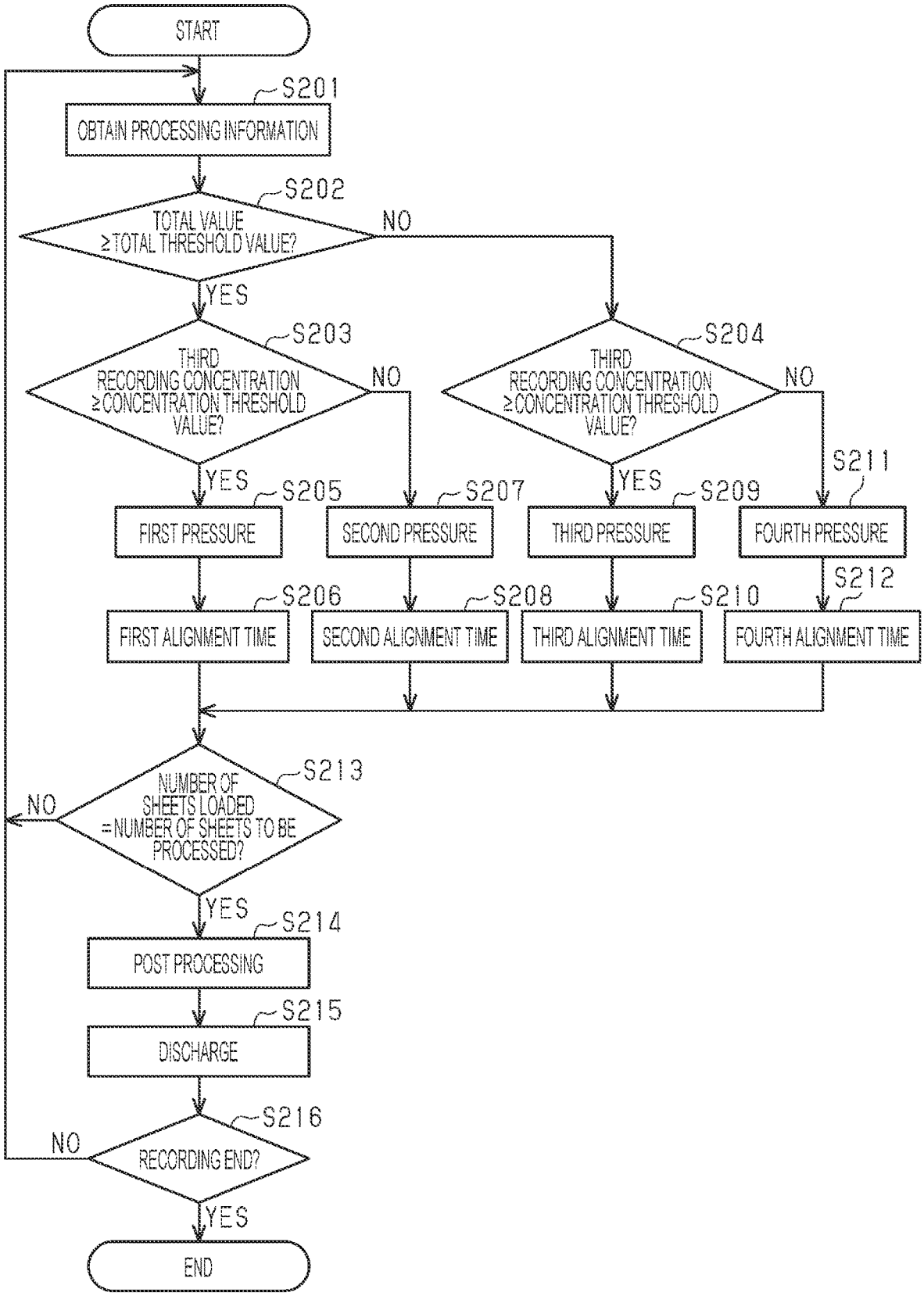
FIG. 4 is a flowchart illustrating an alignment routine according to a second embodiment.

As illustrated in FIG. 4, in step S201, the controller 38 obtains processing information. That is to say, the controller 38 obtains the total value of the first recording concentration, the second recording concentration, and the third recording concentration included in the processing information.

In step S202, the controller 38 compares the total value of the first recording concentration and the second recording concentration with a total threshold value. The total threshold value is set in advance from, for example, an experimental result or the like. When the total value is equal to or higher than the total threshold value, the processing proceeds to YES in step S202, and the processing of the controller 38 proceeds to step S203. When the total value is lower than the total threshold value, the processing proceeds to NO in step S202, and the processing of the controller 38 proceeds to step S204.

The controller 38 performs the same processing in step S203 and step S204. Specifically, in step S203 and step S204, the controller 38 compares the third recording concentration with a concentration threshold value. The concentration threshold value is set by, for example, an experimental result or the like.

When the total value of the first recording concentration and the second recording concentration is equal to or higher than the total threshold value, and the third recording concentration is equal to or higher than the concentration threshold value, the processing in step S202 and step S203 proceeds to YES. In step S205, the controller 38 transports the transport section 31 to the transport position TP, and causes the transport section 31 to press the second medium 17*b* with the first pressure. In step S206, the controller 38 rotates the transport section 31 for the first alignment time to align the second medium 17*b*.

When the total value of the first recording concentration and the second recording concentration is equal to or higher than the total threshold value, and the third recording concentration is lower than the concentration threshold value, the processing in step S202 proceeds to YES, and the processing in step S203 proceeds to NO. In step S207, the controller 38 moves the transport section 31 to the transport position TP, and causes the transport section 31 to press the second medium 17*b* with the second pressure. In step S208, the controller 38 rotates the transport section 31 for the second alignment time to align the second medium 17*b*.

When the total value of the first recording concentration and the second recording concentration is lower than the total threshold value, and the third recording concentration is equal to or higher than the concentration threshold value, the processing in step S202 proceeds to NO, and the processing in step S204 proceeds to YES. In step S209, the controller 38 moves the transport section 31 to the transport position TP, and causes the transport section 31 to press the second medium 17*b* with the third pressure. In step S210, the controller 38 rotates the transport section 31 for the third alignment time to align the second medium 17*b*.

When the total value of the first recording concentration and the second recording concentration is lower than the total threshold value, and the third recording concentration is lower than the concentration threshold value, the processing in step S202 and step S204 proceeds to NO. In step S211, the controller 38 moves the transport section 31 to the transport position TP, and causes the transport section 31 to press the second medium 17*b* with the fourth pressure. In step S212, the controller 38 rotates the transport section 31 for the fourth alignment time to align the second medium 17*b*.

The processing of steps S213 to step S216 is the same as that of steps S106 to step S109 illustrated in FIG. 3, and thus the descriptions thereof will be omitted. When the processing of step S213 step S216 proceeds to NO, the processing of the controller 38 proceeds to step S201. In step S201, the controller 38 obtains the total value of the first recording concentration, the second recording concentration, and the third recording concentration. That is to say, the controller 38 obtains again the third recording concentration of the upper surface of the preceding second medium 17*b* as the first recording concentration of the next first medium 17*a*, and newly obtains the second recording concentration of the lower surface of the next second medium 17*b* and the third recording concentration of the upper surface of the next second medium 17*b*. The controller 38 adds the new first recording concentration and second recording concentration to obtain the total value.

Operation of Second Embodiment

A description will be given of the operation of the present embodiment. Since the time when the controller 38 rotates the paddle 29 and the time when the controller 38 moves the transport section 31 are the same as those in the first embodiment, the descriptions thereof will be omitted.

The controller 38 changes the pressure that the transport section 31 presses the second medium 17*b* at the time of aligning the second medium 17*b* and the time to align the second medium 17*b* based on the first recording concentration, the second recording concentration, and the third recording concentration.

When the total value of the first recording concentration and the second recording concentration is equal to or higher than the total threshold value, the controller 38 reduces the pressure to press the second medium 17*b* compared with the case in which the total value is lower than the total threshold value. When the third recording concentration is equal to or higher than the concentration threshold value, the controller 38 prolongs the alignment time of the second medium 17*b* compared with the case in which the third recording concentration is lower than the concentration threshold value.

Specifically, in the first case in which the total value of the first recording concentration and the second recording concentration is equal to or higher than the total threshold value, and the third recording concentration is equal to or higher than the concentration threshold value, the controller 38 sets the pressure to press the second medium 17*b* to the first pressure. In the first case, the controller 38 sets the alignment time during which the transport section 31 transports the second medium 17*b* to the first alignment time longer than the second alignment time.

In the second case in which the total value of the first recording concentration and the second recording concentration is equal to or higher than the total threshold value, and the third recording concentration is lower than the concentration threshold value, the controller 38 sets the pressure to press the second medium 17*b* to the second pressure. In the second case, the controller 38 sets the alignment time during which the transport section 31 transports the second medium 17*b* to the second alignment time.

In the third case in which the total value of the first recording concentration and the second recording concentration is lower than the total threshold value, and the third recording concentration is equal to or higher than the concentration threshold value, the controller 38 sets the pressure to press the second medium 17*b* to the third pressure. In the third case, the controller 38 sets the alignment time during which the transport section 31 transports the second medium 17*b* to the third alignment time.

In the fourth case in which the total value of the first recording concentration and the second recording concentration is lower than the total threshold value, and the third recording concentration is lower than the concentration threshold value, the controller 38 sets the pressure to press the second medium 17*b* to the fourth pressure. In the fourth case, the controller 38 sets the alignment time during which the transport section 31 transports the second medium 17*b* to the fourth alignment time.

Advantages of Second Embodiment

A description will be given of the advantages of the present embodiment.

4. The slipperiness of the second medium 17*b* against the first medium 17*a* varies depending on the recording concentrations of the surfaces that touch each other. Specifically, when the total value of the first recording concentration and the second recording concentration is high, the first medium and the second medium are hard to slip with each other, and an image is easy to be damaged compared with the case in which the total value is low. On that point, when the total value of the first recording concentration and the second recording concentration is equal to or higher than the total threshold value, the controller 38 reduces the pressure that presses the medium 17 compared with the case in which the total value of the first recording concentration and the second recording concentration is lower than the total threshold value. Accordingly, it is possible to reduce the risk of damaging an image recorded on the medium 17.

5. The transport section 31 transports the second medium 17*b* while keeping contact with the upper surface of the second medium 17*b* discharged by the discharge section. Accordingly, when the third recording concentration is high, the transport section 31 is easier to be damaged compared with the case in which the recording concentration is low. On that point, when the third recording concentration is equal to or higher than the concentration threshold value, the controller 38 reduces the pressure that presses the second medium 17*b* compared with the case in which the third recording concentration is lower than the concentration threshold value. Accordingly, it is possible to reduce the risk of damaging an image recorded on the second medium 17*b*.

6. The transport section 31 transports and aligns the second medium 17*b*. When the alignment time during which the transport section 31 transports the second medium 17*b* is long, the degree of alignment increases compared with the case of short alignment time. However, when the alignment time is long, the risk of damaging an image increases. In the first case, the second medium 17*b* is transported in the first alignment time longer than the second alignment time. The first pressure that presses the second medium 17*b* in the first case is lower than the second pressure that presses second medium 17*b* in the second case. Accordingly, with low pressure and for a long alignment time, it is possible to increase the degree of alignment while suppressing damage.

7. The third pressure that presses the second medium 17*b* in the third case is lower than the fourth pressure that presses the second medium 17*b* in the fourth case. Accordingly, in the third case, the image is hard to be damaged compared with the fourth case. In the third case, the second medium 17*b* is transported for the third alignment time longer than the fourth alignment time. Accordingly, it is possible for post-processing apparatus 14 to increase the degree of alignment while suppressing damage on the image.

Third Embodiment

Next, a description will be given of the post-processing apparatus according to a third embodiment with reference to the drawings. The third embodiment has an alignment routine that is different from those of the first embodiment and the second embodiment. The other components are almost the same as those of the first embodiment and the second embodiment. Thus the same sign is given to the same component as that in the first embodiment and the second embodiment, and duplicated description will be omitted.

As illustrated in FIG. 2, it is possible for the post-processing section 33 to perform the first processing or the second processing on the first medium 17*a*. The first processing according to the present embodiment is staple processing. The second processing according to the present embodiment is shift processing.

The processing information according to the present embodiment includes post-processing information regarding the processing that the post-processing section 33 performs on the first medium 17*a*. That is to say, the post-processing information indicates whether to perform the first processing on the first medium 17*a* or to perform the second processing. The processing information may include the third recording concentration of the upper surface of the second medium 17*b* discharged by the first discharge section 23 onto the processing tray 24.

Alignment Routine of Third Embodiment

Next, a description will be given of the alignment routine with reference to a flowchart illustrated in FIG. 5. The alignment routine is executed when an instruction of recording with post-processing is input.

Figure 5:
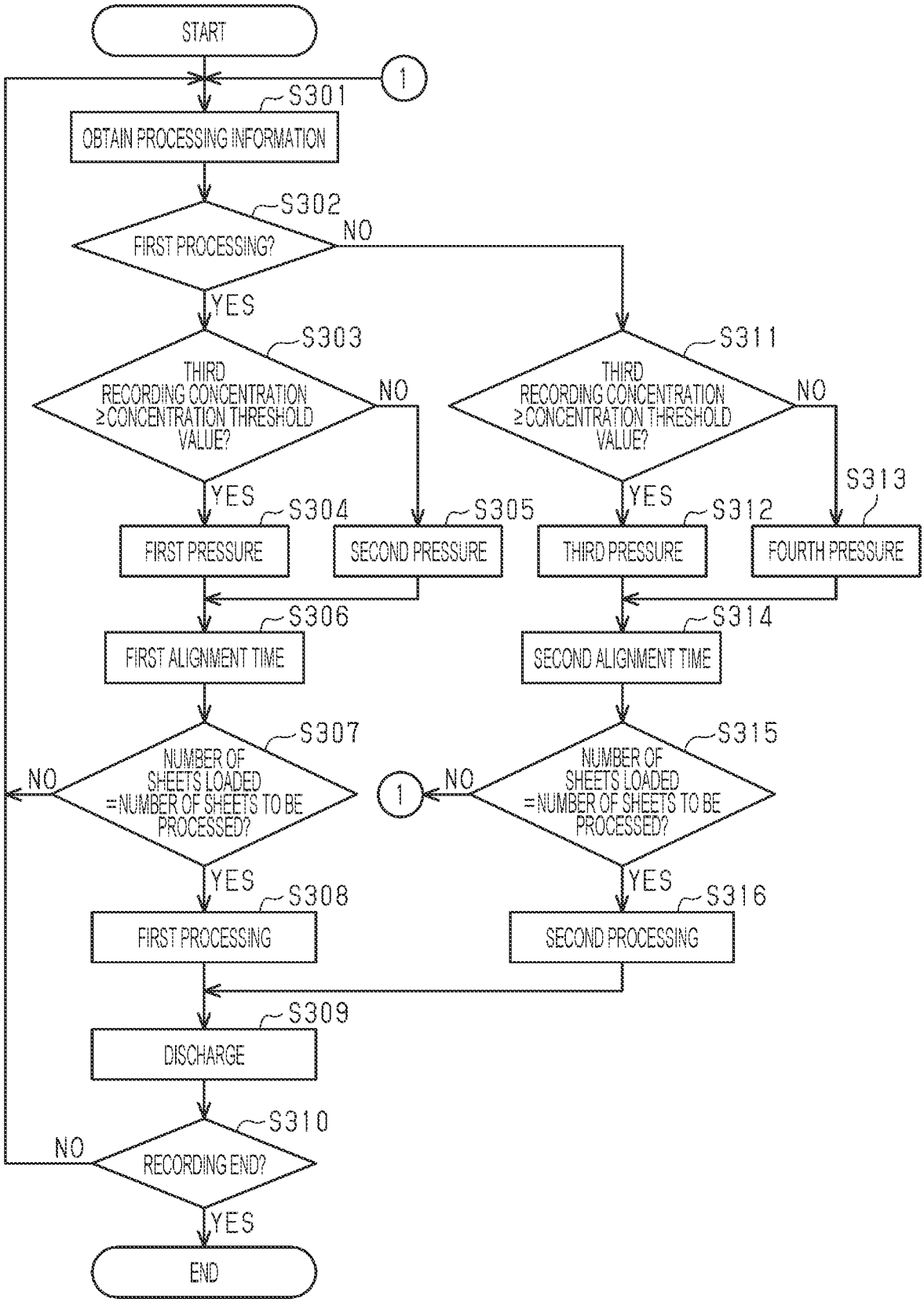
FIG. 5 is a flowchart illustrating an alignment routine according to a third embodiment.

As illustrated in FIG. 5, in step S301, the controller 38 obtains processing information. That is to say, the controller 38 obtains post-processing information and third recording concentration included in the processing information. In step S302, the controller 38 determines whether the obtained post-processing information specifies the execution of the first processing or the execution of the second processing.

When the post-processing information specifies the execution of the first processing, the processing in step S302 proceeds to YES, and the processing of the controller 38 proceeds to step S303. When the post-processing information specifies the execution of the second processing, the processing in step S302 proceeds to NO, and the processing of the controller 38 proceeds to step S311.

The processing of steps S303 to S307 is the same as that of steps S203, S205, S207, S206, and S213 illustrated in FIG. 4, and thus the descriptions thereof will be omitted. In step S308, the controller 38 causes the post-processing section 33 to perform the first processing.

The processing of steps S309 and S310 is the same as that of steps S215 and S216 illustrated in FIG. 4, and thus the descriptions thereof will be omitted. The processing of steps S311 to S315 is the same as that of steps S204, S209, S211, S208, and S213 illustrated in FIG. 4, and thus the descriptions thereof will be omitted.

In step S316, the controller 38 causes the post-processing section 33 to perform the second processing. When the processing of steps S307, S310, and S315 proceeds to NO, the processing of the controller 38 proceeds to step S301. In step S301, the controller 38 obtains post-processing information and third recording concentration. That is to say, the controller 38 obtains post-processing information to be performed on the next second medium 17*b* and the third recording concentration of the upper surface of the next second medium 17*b*.

Operation of Third Embodiment

A description will be given of the operation of the present embodiment. Since the time when the controller 38 rotates the paddle 29 and the time when the controller 38 moves the transport section 31 are the same as those in the first embodiment, the descriptions thereof will be omitted.

The staple processing, which is the first processing according to the present embodiment, is processing for binding a plurality of first mediums 17*a* with a staple. When the first processing is performed, a plurality of first mediums 17*a* are restricted with a staple, and thus it is not possible to align again the first mediums 17*a* with each other. Accordingly, a high degree of alignment is required for the first medium 17*a* to be subjected to staple processing.

The shift processing, which is the second processing according to the present embodiment, is processing for shifting the position of a bundle loaded with the same number of sheets of the first medium 17*a* as the number of sheets to be processed for each bundle. For example, the post-processing section 33 shifts the bundles of the first mediums 17*a* every other bundle in the width direction X. The second discharge section 25 discharges the first mediums 17*a* in the second discharge direction D2 with the first mediums 17*a* shifted by the post-processing section 33. When the first medium 17*a* is mounted on the loading tray 26, the first medium 17*a* becomes a third medium 17*c*. A bundle of third mediums 17*c* located at a reference position and a bundle of third mediums 17*c* located at a position shifted from the reference position in the width direction X are piled on the loading tray 26.

In the shift processing, a plurality of first mediums 17*a* included in a bundle are piled on the loading tray 26 without being restricted to become a plurality of third mediums 17*c*. It is possible to realign a plurality of third mediums 17*c*. Accordingly, the degree of alignment required for the first medium 17*a* to be subjected to the shift processing is low compared with the case of the staple processing.

When the controller 38 performs the first processing, the controller 38 reduces the pressure to press the second medium 17*b*, and prolongs the alignment time for the transport section 31 to transport the medium 17 compared with the case of performing the second processing. When the third recording concentration is equal to or higher than the concentration threshold value, the controller 38 reduces the pressure that the transport section 31 presses the second medium 17*b* compared with the case in which the third recording concentration is lower than the concentration threshold value.

Specifically, when the post-processing section 33 performs the first processing, and the third recording concentration is equal to or higher than the concentration threshold value, the controller 38 sets the pressure to press the second medium 17*b* to the first pressure lower than the second pressure.

When the post-processing section 33 performs the first processing, and the third recording concentration is lower than the concentration threshold value, the controller 38 sets the pressure to press the second medium 17*b* to the second pressure higher than the first pressure.

When the post-processing section 33 performs the second processing, and the third recording concentration is equal to or higher than the concentration threshold value, the controller 38 sets the pressure to press the second medium 17*b* to the third pressure lower than the fourth pressure.

When the post-processing section 33 performs the second processing, and the third recording concentration is lower than the concentration threshold value, the controller 38 sets the pressure to press the second medium 17*b* to the fourth pressure higher than the third pressure.

The controller 38 rotates the transport section 31 that presses the second medium 17*b* with the set pressure for the time in accordance with the processing performed by the post-processing section 33. That is to say, when the post-processing section 33 performs the first processing, the controller 38 causes the second medium 17*b* to be transported in the alignment direction D3 for the first alignment time. When the post-processing section 33 performs the second processing, the controller 38 causes the second medium 17*b* to be transported in the alignment direction D3 for the second alignment time. The first transport time is longer than the second transport time. Accordingly, the first medium 17*a* that is subjected to the first processing is aligned with higher accuracy than the second medium 17*b* that is subjected to the second processing.

Advantages of Third Embodiment

A description will be given of the advantages according to the present embodiment.

8. When performing the first processing, the controller 38 reduces the pressure to press the second medium 17*b*, and prolongs the alignment time for the transport section 31 to press the second medium 17*b* compared with the case of performing the second processing. The degree of alignment varies depending on the length of alignment time. Specifically, when the alignment time is long, the degree of alignment is higher than the case of short alignment time. When performing the first processing, the controller 38 reduces the pressure to press the second medium 17*b* compared with the case of performing the second processing. Accordingly, it is possible to suppress image damage even when the transport time of the second medium 17*b* is long.

9. When the third recording concentration is equal to or higher than the concentration threshold value, the controller 38 reduces the pressure to press the second medium 17*b* compared with the case in which the third recording concentration is lower than the concentration threshold value. Accordingly, it is possible to reduce the risk of damaging an image recorded on the second medium 17*b*.

Fourth Embodiment

Next, a description will be given of the post-processing apparatus according to a fourth embodiment with reference to the drawings. The fourth embodiment has an alignment routine that is different from those of the first to the third embodiments. The other components are almost the same as those of the first to the third embodiments. Thus the same sign is given to the same component as that in the first to the third embodiments, and duplicated description will be omitted.

The processing information according to the present embodiment includes humidity information regarding humidity. For example, the humidity information is a ratio of the amount of water vapor in the air to the amount of saturated water vapor. The amount of saturated water vapor varies in accordance with the temperature. Accordingly, the processing information may include temperature information regarding the temperature of the environment in which the post-processing apparatus 14 is disposed. When the temperature is high, the amount of saturated water vapor is larger than the case of low temperature. When humidity is high, the amount of water vapor is larger than that of the case of low humidity. Accordingly, when both temperature and humidity are high, the amount of water vapor included in the air is larger than that of the case in which temperature and humidity are low.

The post-processing apparatus 14 may include a measuring instrument that is measurable of at least one of temperature and humidity, which is not illustrated in the figure. A measuring instrument may be disposed separately from the post-processing apparatus 14. It may be possible to input the temperature information and the humidity information by the operation of the operation section 18. The controller 38 may obtain the temperature information and the humidity information from a measuring instrument, the operation section 18, and an external device such as a server or the like.

Alignment Routine of Fourth Embodiment

Figure 6:
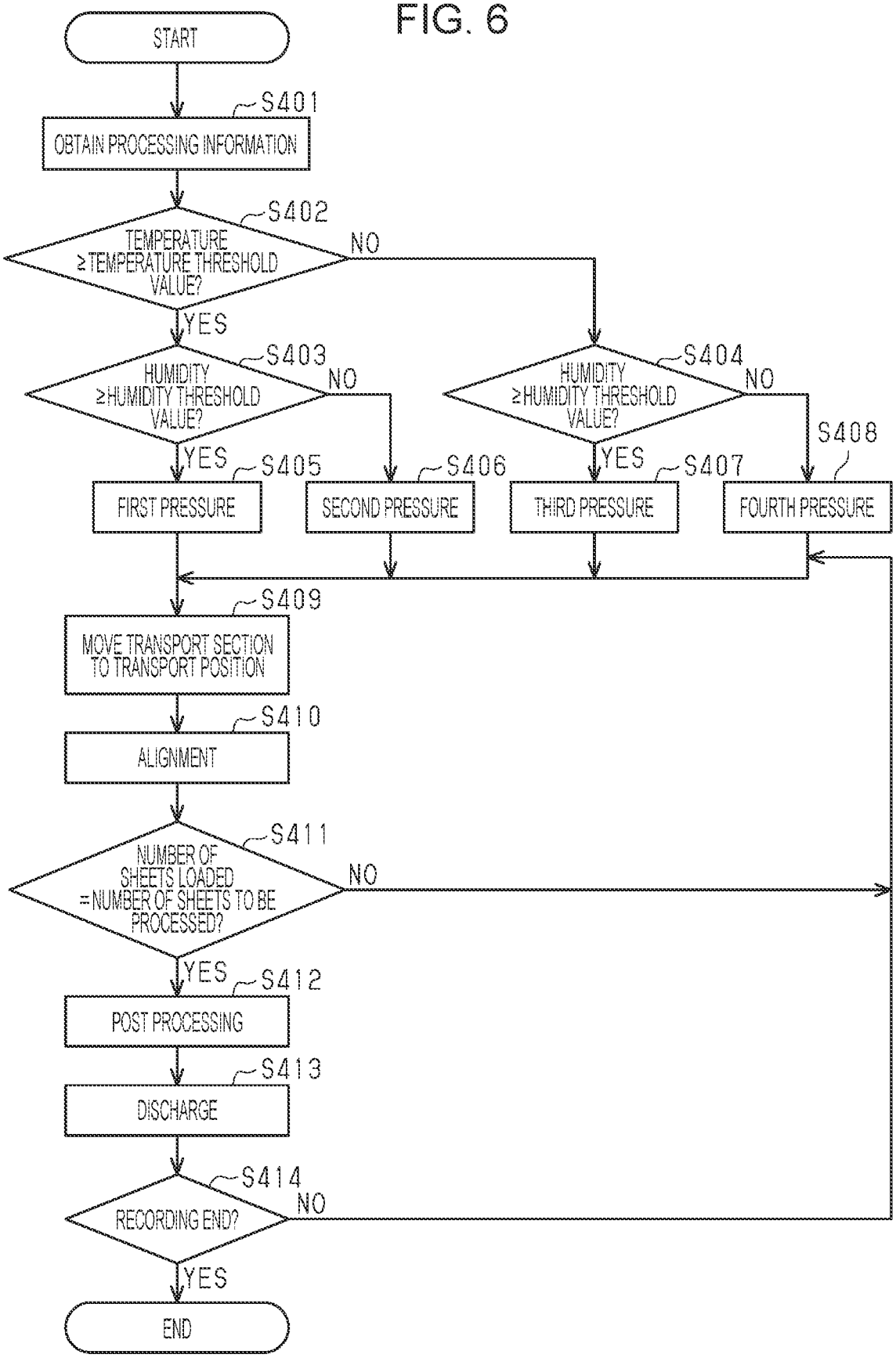
FIG. 6 is a flowchart illustrating an alignment routine according to a fourth embodiment.

Next, a description will be given of the alignment routine with reference to a flowchart illustrated in FIG. 6. The alignment routine is executed when an instruction of recording with post-processing is input.

In step S401, the controller 38 obtains processing information. That is to say, the controller 38 obtains temperature information and humidity information. In step S402, the controller 38 compares the temperature with a temperature threshold value. The temperature threshold value is set in advance from, for example, an experimental result or the like. When the temperature is equal to or higher than the temperature threshold value, the processing in step S402 proceeds to YES, and the processing of the controller 38 proceeds to step S403. When the temperature is lower than the temperature threshold value, the processing in step S402 proceeds to NO, and the processing of the controller 38 proceeds to step S404.

The controller 38 performs the same processing in step S403 and step S404. Specifically, in step S403 and step S404, the controller 38 compares the humidity with a humidity threshold value. The humidity threshold value is set in advance from, for example, an experimental result or the like.

When the temperature is equal to or higher than the temperature threshold value, and the humidity is equal to or higher than the humidity threshold value, the processing in step S402 and step S403 proceeds to YES. In step S405, the controller 38 sets the pressure that the transport section 31 presses the second medium 17*b* to the first pressure.

When the temperature is equal to or higher than the temperature threshold value, and the humidity is lower than the humidity threshold value, the processing in step S402 proceeds to YES, and the processing in step S403 proceeds to NO. In step S406, the controller 38 sets the pressure that the transport section 31 presses the second medium 17*b* to the second pressure.

When the temperature is lower than the temperature threshold value, and the humidity is equal to or higher than the humidity threshold value, the processing in step S402 proceeds to NO, and the processing in step S404 proceeds to YES. In step S407, the controller 38 sets the pressure that the transport section 31 presses the second medium 17*b* to the third pressure.

When the temperature is lower than the temperature threshold value, and the humidity is lower than the humidity threshold value, the processing in step S402 and step S404 proceeds to NO. In step S408, the controller 38 sets the pressure that the transport section 31 presses the second medium 17*b* to the fourth pressure.

In step S409, the controller 38 controls the position change section 32 so as to move the transport section 31 to the transport position TP. That is to say, the transport section 31 presses the second medium 17*b* with the pressure set in steps S405 to step S408. The processing in steps S410 to S414 is the same as the processing in steps S105 to step S109 illustrated in FIG. 3, and thus the description thereof will be omitted.

When the processing in step S411 proceeds to NO or the processing in step S414 proceeds to NO, the processing of the controller 38 proceeds to step S409. In step S409, the controller 38 moves the transport section 31 to the transport position TP so that the transport section 31 presses the next second medium 17*b* with the set pressure.

Operation of Fourth Embodiment

A description will be given of the operation of the present embodiment. Since the time when the controller 38 rotates the paddle 29 and the time when the controller 38 moves the transport section 31 are the same as those in the first embodiment, the descriptions thereof will be omitted.

For example, when the medium 17 has hygroscopicity, the medium 17 absorbs water vapor in the air. When there is a large amount of water vapor in the air, the medium 17 absorbs more water vapor than the case in which the amount of water vapor is small. The front surface of the moist medium 17 that has absorbed water vapor is easy to collect liquid attached by recording. That is to say, liquid is hard to penetrate the medium 17. When the transport section 31 makes contact with the medium 17 in the state in which the front surface of the medium 17 is wet with the liquid, an image is easy to be damaged. In other words, when there is a large amount of water vapor in the air, and the medium 17 is wet, an image is easier to be damaged compared with the state in which the amount of water vapor is small, and the medium 17 is dry.

When the humidity is equal to or higher than the humidity threshold value, the controller 38 reduces the pressure to press the second medium 17*b* compared with the case in which the humidity is lower than the humidity threshold value. When the temperature is equal to or higher than the temperature threshold value, the controller 38 may reduce the pressure to press the second medium 17*b* compared with the case in which the temperature is lower than the temperature threshold value. The controller 38 may change the pressure that the transport section 31 presses the second medium 17*b* at the time of aligning the second medium 17*b* based on the temperature and the humidity of the place where the post-processing apparatus 14 is disposed.

When the temperature is equal to or higher than the temperature threshold value, and the humidity is equal to or higher than the humidity threshold value, the controller 38 sets the pressure to press the second medium 17*b* to the first pressure. The first pressure is the lowest among the first pressure to the fourth pressure.

When the temperature is equal to or higher than the temperature threshold value, and the humidity is lower than the humidity threshold value, the controller 38 sets the pressure to press the second medium 17*b* to the second pressure. The second pressure is higher than the first pressure and lower than the third pressure.

When the temperature is lower than the temperature threshold value, and the humidity is equal to or higher than the humidity threshold value, the controller 38 sets the pressure to press the second medium 17*b* to the third pressure. The third pressure is higher than the second pressure and lower than the fourth pressure.

When the temperature is lower than the temperature threshold value, and the humidity is lower than the humidity threshold value, the controller 38 sets the pressure to press the second medium 17*b* to the fourth pressure. The fourth pressure is the highest among the first to the fourth pressures.

Advantages of Fourth Embodiment

A description will be given of the advantages of the present embodiment.

10. In the case of hygroscopic medium 17, the medium 17 absorbs water vapor in the air, and thus liquid attached by recording sometimes becomes hard to penetrate the medium 17. That is to say, when there is a large amount of water vapor, liquid is hard to penetrate the medium 17 compared with the case in which the amount of water vapor is small, and thus an image is easy to be damaged. On that point, when the humidity is equal to or higher than the humidity threshold value, the controller 38 reduces the pressure to press the second medium 17*b* compared with the case in which the humidity is lower than the humidity threshold value. Accordingly, it is possible to reduce the risk of damaging an image recorded on the second medium 17*b*.

Fifth Embodiment

Next, a description will be given of the post-processing apparatus according to a fifth embodiment with reference to the drawings. The fifth embodiment has an alignment routine different from those of the first to the fourth embodiments. The other components are almost the same as those of the first to the fourth embodiments. Thus the same sign is given to the same component as that in the first to the fourth embodiments, and duplicated descriptions will be omitted.

The processing information according to the present embodiment includes recording surface information on the recorded surface of the medium 17. The recording surface information indicates whether information is recorded on both sides of the medium 17 or on one side.

Alignment Routine of Fifth Embodiment

Next, a description will be given of the alignment routine with reference to a flowchart illustrated in FIG. 7. The alignment routine is executed when an instruction of recording with post-processing is input.

Figure 7:
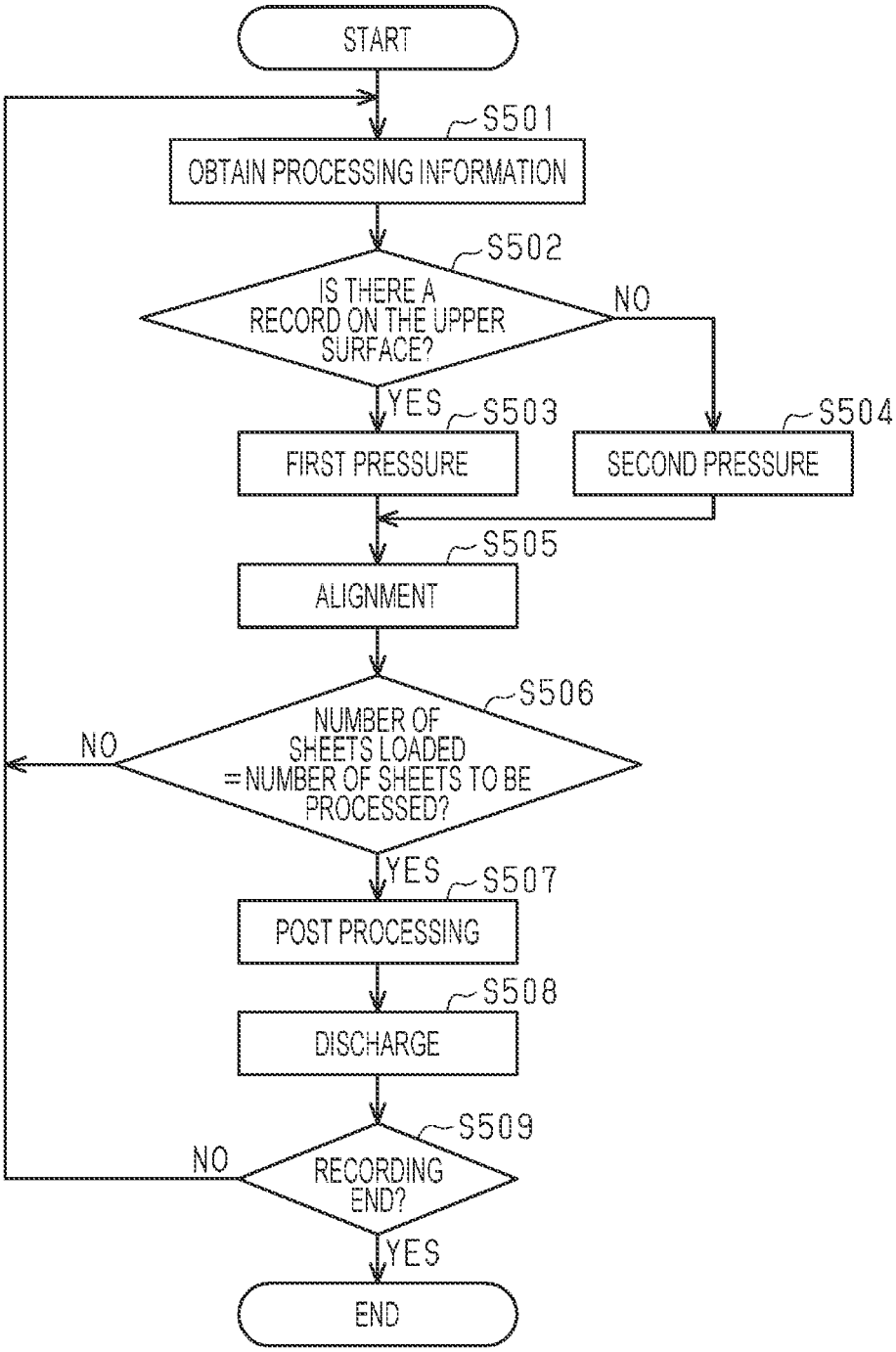
FIG. 7 is a flowchart illustrating an alignment routine according to a fifth embodiment.

As illustrated in FIG. 7, in step S501, the controller 38 obtains processing information. That is to say, the controller 38 obtains recording surface information included in the processing information. In step S502, the controller 38 determined whether or not information is recorded on the upper surface of the second medium 17*b* discharged from the first discharge section 23. When information is recorded on both sides of the second medium 17*b*, and when a single-sided printed second medium 17*b* is discharged in the state in which the recorded surface of the second medium 17*b* is facing up, the processing in step S502 proceeds to YES, and the processing of the controller 38 proceeds to step S503.

When a single-sided printed second medium 17*b* is discharged in the state in which the recorded surface of the second medium 17*b* is facing down, the processing in step S502 proceeds to NO, and the processing of the controller 38 proceeds to step S504. The processing of steps S503 to S509 is the same as that of steps S103 to S109 illustrated in FIG. 3, and thus the description thereof will be omitted.

Operation of Fifth Embodiment

A description will be given of the operation of the present embodiment. Since the time when the controller 38 rotates the paddle 29 and the time when the controller 38 moves the transport section 31 are the same as those in the first embodiment, the descriptions thereof will be omitted.

The controller 38 changes the pressure that the transport section 31 presses the second medium 17*b* at the time of aligning the second medium 17*b* depending on whether the upper surface of the second medium 17*b* pressed by the transport section 31 is a recording surface or not. When the upper surface of the second medium 17*b* pressed by the transport section 31 is a recording surface, an image is easier to be damaged compared with the case in which the upper surface is not a recording surface. Accordingly, the controller 38 reduced the pressure that the transport section 31 presses the second medium 17*b* when the transport section 31 is a recording surface.

Specifically, when information is recorded on the upper surface of the second medium 17*b* that keeps contact with the transport section 31, the controller 38 sets the pressure to press the second medium 17*b* to the first pressure lower than the second pressure. When information is not recorded on the upper surface of the second medium 17*b* that keeps contact with the transport section 31, the controller 38 sets the pressure to press the second medium 17*b* to the second pressure higher than the first pressure.

Advantages of Fifth Embodiment

A description will be given of the advantages according to the present embodiment.

11. The transport section 31 transports the second medium 17*b* while keeping contact with the upper surface of the second medium 17*b*. Thus, when an image is recorded on the upper surface of the second medium 17*b*, the recorded image is easy to be damaged. On that point, when information is recorded on the upper surface of the second medium 17*b*, the controller 38 reduces the pressure to press the second medium 17*b* compared with the case in which information is not recorded on the upper surface of the second medium 17*b*. That is to say, it is possible for the post-processing apparatus 14 to press the second medium 17*b* with the pressure in accordance with the recorded second medium 17*b*, and thus to reduce the risk of damaging the image recorded on the second medium 17*b*.

It is possible to change the present embodiment as follows and implement the embodiment. It is possible to carry out the present embodiment and the following variations in combination with each other within the scope of being technically consistent.

The processing information may include thickness information on the thickness of the medium 17. The thickness information may be a numeric value indicating the degree of thickness of the medium 17 or a basis weight of the medium 17. When the medium 17 is thick, the controller 38 may reduce the pressure to press the second medium 17*b* compared with the case in which the second medium 17*b* is thin.

The processing information may include size information regarding the size of the medium 17. The size information may be at least one of the vertical and the horizontal sizes of the medium 17, or may be a standard size, such as A4, A3, or the like. The controller 38 may change the pressure to press the second medium 17*b* in accordance with the size of the medium 17. For example, when the size of the medium 17 is small, the controller 38 may reduce the pressure to press the medium 17 compared with the case of large size. It is easier for the transport section 31 to transport a small size medium 17 than a large size medium 17. Accordingly, it is possible to transport a small size medium 17 with a lower pressing pressure.

The processing information may include resolution information regarding the resolution of the recording image. When the resolution is high, the size of droplets discharged from the recording section 21 is small, and the number of discharges is large compared with the case of low resolution. Accordingly, when the resolution is high, it takes a long time for the recording, and thus it is possible to prolong the transport time in accordance with the recording time. Accordingly, when the resolution is low, and the transport time is short, it may be possible to reduce the pressure to press the second medium 17*b* compared with the case in which the resolution is high, and the transport time is long.

The processing information may include the amount of water vapor information regarding the amount of water vapor in the air. The amount of water vapor is the amount of water vapor per unit volume. When the amount of water vapor is equal to or higher than the water vapor threshold value, the controller 38 may reduce the pressure to press the second medium 17*b* compared with the case in which the amount of water vapor is lower than the water vapor threshold value. The controller 38 may calculate the amount of water vapor from humidity. The controller 38 may calculate the amount of water vapor from temperature and humidity. A water vapor threshold value may be a value calculated from a humidity threshold value and a temperature threshold value.

In the third embodiment, the post-processing section 33 may perform punch processing as the first processing and may perform shift processing as the second processing. The post-processing section 33 may perform staple processing as the first processing, and may perform punch processing as the second processing.

In the third embodiment, the processing information may not include the third recording concentration. The controller 38 may change the pressure to press the second medium 17*b* based on the post-processing information. In the second to the fourth embodiments, the second pressure and the third pressure may be the same pressure.

In the second to the fourth embodiments, the first pressure and the third pressure may be the same pressure. The second pressure and the fourth pressure may be the same pressure. In the second embodiment, the controller 38 may set the alignment time during which the transport section 31 transports the second medium 17*b* regardless of the recording concentrations of the first medium 17*a* and the second medium 17*b*.

In the second embodiment, the processing information may include the first recording concentration and the second recording concentration. The controller 38 may calculate the total value of the first recording concentration and the second recording concentration in the process of executing the alignment routine.

In the second embodiment, the processing information may not include the third recording concentration. The controller 38 may change the pressure to press the second medium 17*b* based on the total value of the first recording concentration and the second recording concentration.

It is possible to freely select liquid as long as the liquid is able to be used for recording information on the medium 17 by being attached to the medium 17. For example, the ink includes a product produced by dissolving, dispersing, or mixing particles of a functional material including a solid body, such as pigment, metal particles, or the like in solvent. The ink also includes various compositions, such as water-based ink, oil-based ink, gel ink, hot melt ink, or the like.

In the following, a description will be given of the technical ideas and the operational advantages that are grasped from the above-described embodiments and variations.

A. A post-processing apparatus includes a discharge section configured to discharge a medium having thereon information recorded by a recording section, the recording section recording the information by discharging liquid; a processing tray configured to be loaded with the medium discharged by the discharge section; an edge alignment section disposed on the processing tray and configured to align an edge of the medium; a transport section having contact with an upper surface of the medium mounted on the processing tray and configured to transport the medium to the edge alignment section; a position change section configured to change a relative position of the transport section with respect to the processing tray; a controller configured to change pressure when the transport section makes contact with the medium by controlling the position change section; and a post-processing section configured to perform post-processing on the medium on the processing tray, wherein the controller changes the pressure based on processing information regarding processing to be performed on the medium.

With this configuration, the controller changes the pressure that the transport section presses a medium based on the processing information regarding the processing performed on the medium. Accordingly, it is possible for the transport section to press the medium with the pressure in accordance with the state of the medium, and thus to reduce the risk of damaging an image recorded on the medium.

B. In the post-processing apparatus, the processing information may include a transport time period from when the recording section records information on the medium to when the discharge section discharges the medium, and when the transport time is shorter than a transport threshold value, the controller may set the pressure to a first pressure, whereas when the transport time is equal to or longer than the transport threshold value, the controller may set the pressure to a second pressure, where the first pressure is lower than the second pressure.

Drying of an image recorded on the medium progresses while the medium is being transported. Accordingly, when the transport time is short, the medium is sometimes discharged from the discharge section in the state in which drying of the image is insufficient. An image with insufficient drying is easy to be damaged compared with an image that is sufficiently dry. With this configuration, when the transport time is shorter than the transport threshold value, the controller reduces the pressure to press the medium compared with the case in which the transport time is equal to or higher than the transport threshold value. That is to say, it is possible for the post-processing apparatus to press the medium with the pressure in accordance with the dry state, and to reduce the risk of damaging the image recorded on the medium.

C. In the post-processing apparatus, the processing information may include a total value of a first recording concentration of an upper surface of a first medium mounted on the processing tray and a second recording concentration of a lower surface of a second medium discharged on the processing tray by the discharge section subsequently to the first medium, and when the total value is equal to or higher than a total threshold value, the controller may lower the pressure than the pressure of when the total value is lower than the total threshold value.

The slipperiness of the second medium against the first medium varies depending on the recording concentrations of the surfaces that touch each other. Specifically, when the total value of the first recording concentration and the second recording concentration is high, the first medium 17*a* and the second medium 17*b* are hard to slip with each other, and an image is easy to be damaged compared with the case in which the total value is low. On that point, with this configuration, when the total value of the first recording concentration and the second recording concentration is equal to or higher than the total threshold value, the controller reduces the pressure to press the medium compared with the case in which the total value is lower than the total threshold value. Accordingly, it is possible to reduce the risk of damaging an image recorded on the medium.

D. In the post-processing apparatus, the processing information may further include a third recording concentration of an upper surface of the second medium, and in a first case in which the total value is equal to or higher than the total threshold value, and the third recording concentration is equal to or higher than a concentration threshold value, the controller may set the pressure to a first pressure, whereas in a second case in which the total value is equal to or higher than the total threshold value, and the third recording concentration is lower than the concentration threshold value, the controller may set the pressure to a second pressure, where the first pressure may be lower than the second pressure.

The transport section transports the second medium while keeping contact with the upper surface of the second medium discharged by the discharge section. Accordingly, when the third recording concentration is high, the transport section is easier to be damaged compared with the case in which the recording concentration is low. On that point, when the third recording concentration is equal to or higher than the concentration threshold value, the controller reduces the pressure that presses the second medium compared with the case in which the third recording concentration is lower than the concentration threshold value. Accordingly, it is possible to reduce the risk of damaging an image recorded on the second medium.

E. In the post-processing apparatus, the processing information may further include a third recording concentration of an upper surface of the second medium, and in a third case in which the total value is lower than the total threshold value, and the third recording concentration may be equal to or higher than a concentration threshold value, the controller may set the pressure to a third pressure, whereas in a fourth case in which the total value is lower than the total threshold value, and the third recording concentration may be lower than the concentration threshold value, the controller may set the pressure to a fourth pressure, where the third pressure may be lower than the fourth pressure. Accordingly, it is possible to obtain the same advantages as those of the post-processing apparatus described above.

F. In the post-processing apparatus, in the first case, the controller may set an alignment time period during which the transport section transports the second medium to a first alignment time period, whereas in the second case, the controller may set the alignment time period to a second alignment time, where the first alignment time may be longer than the second alignment time.

The transport section transports and aligns the second medium. When the alignment time during which the transport section transports the second medium is long, the degree of alignment increases compared with the case of short alignment time. However, when the alignment time is long, the risk of damaging an image increases. With this configuration in the first case, the second medium is transported in the first alignment time that is longer than the second alignment time. The first pressure that presses the second medium in the first case is lower than the second pressure that presses second medium in the second case. Accordingly, with low pressure and for a long alignment time, it is possible to increase the degree of alignment while suppressing damage.

G. In the post-processing apparatus, in the third case, the controller may set an alignment time period during which the transport section transports the second medium to a third alignment time period, and in the fourth case, the controller may set the alignment time period to a fourth alignment time period, where the third alignment time period may be longer than the fourth alignment time period.

The third pressure that presses the second medium in the third case is lower than the fourth pressure that presses the second medium in the fourth case. Accordingly, in the third case, the image is hard to be damaged compared with the fourth case. In the third case, the second medium is transported for the third alignment time that is longer than the fourth alignment time. Accordingly, it is possible for post-processing apparatus to increase the degree of alignment while suppressing damage on the image.

H. In the post-processing apparatus, the post-processing section may be configured to perform first processing or second processing on the medium, the processing information may include post-processing information regarding processing to be performed on the medium by the post-processing section, and when the controller performs the first processing, the controller may lower the pressure than the pressure of when the controller performs the second processing and may prolong the alignment time for the transport section to transport the medium.

With this configuration, when performing the first processing, the controller reduces the pressure to press the second medium, and prolongs the alignment time for the transport section to press the second medium compared with the case of performing the second processing. The degree of alignment varies depending on the length of alignment time. Specifically, when the alignment time is long, the degree of alignment is higher than the case of short alignment time. When performing the first processing, the controller reduces the pressure to press the second medium compared with the case of performing the second processing. Accordingly, it is possible to suppress image damage even when the transport time of the second medium is long.

I. In the post-processing apparatus, the processing information may further include a recording concentration of an upper surface of the medium to be discharged by the discharge section on the processing tray, and when the post-processing section performs the first processing, and the recording concentration may be equal to or higher than a concentration threshold value, the controller may set the pressure to a first pressure, whereas when the post-processing section performs the first processing, and the recording concentration may be lower than the concentration threshold value, the controller may set the pressure to a second pressure, where the first pressure may be less than the second pressure.

With this configuration, when the recording concentration is equal to or higher than the concentration threshold value, the controller reduces the pressure to press the second medium compared with the case in which the recording concentration is lower than the concentration threshold value. Accordingly, it is possible to reduce the risk of damaging an image recorded on the medium.

J. In the post-processing apparatus, the processing information may further include a recording concentration of an upper surface of the medium to be discharged by the discharge section onto the processing tray, and when the post-processing section performs the second processing, and the recording concentration is equal to or higher than a concentration threshold value, the controller may set the pressure to a third pressure, whereas when the post-processing section performs the second processing, and the recording concentration is lower than the concentration threshold value, the controller may set the pressure to a fourth pressure, where the third pressure may be lower than the fourth pressure. With this configuration, it is possible to obtain the same advantages as those of the post-processing apparatus described above.

K. In the post-processing apparatus, the processing information includes humidity information regarding humidity, and when the humidity is equal to or higher than a humidity threshold value, the controller lowers the pressure than the pressure of when the humidity is lower than the humidity threshold value.

In the case of hygroscopic medium, the medium absorbs water vapor in the air, and thus liquid attached by recording sometimes becomes hard to penetrate the medium. That is to say, when there is a large amount of water vapor, liquid is hard to penetrate the medium compared with the case in which the amount of water vapor is small, and thus an image is easy to be damaged. On that point, when the humidity is equal to or higher than the humidity threshold value, the controller reduces the pressure to press the second medium compared with the case in which the humidity is lower than the humidity threshold value. Accordingly, it is possible to reduce the risk of damaging an image recorded on the second medium.

L. In the post-processing apparatus, the processing information may include recording surface information regarding a recorded surface of the medium, when recording is performed on an upper surface of the medium having contact with the transport section, the controller may set the pressure to a first pressure, whereas when recording is not performed on an upper surface of the medium having contact with the transport section, the controller may set the pressure to a second pressure, where the first pressure may be lower than the second pressure.

The transport section transports the medium while keeping contact with the upper surface of the medium. Thus, when an image is recorded on the upper surface of medium, the recorded image is easy to be damaged. On that point, with this configuration, when information is recorded on the upper surface of the medium, the controller reduces the pressure to press the medium compared with the case in which information is not recorded on the upper surface of the medium. That is to say, it is possible for the post-processing apparatus to press the medium with the pressure in accordance with the recorded medium, and thus to reduce the risk of damaging the image recorded on the medium.

What is claimed is:

1. A post-processing apparatus comprising:

a discharge section configured to discharge a medium having thereon information recorded by a recording section, the recording section recording the information by discharging liquid;

a processing tray configured to be loaded with the medium discharged by the discharge section;

an edge alignment section disposed on the processing tray and configured to align an edge of the medium;

a transport section having contact with an upper surface of the medium mounted on the processing tray and configured to transport the medium to the edge alignment section;

a position change section configured to change a relative position of the transport section with respect to the processing tray;

a controller configured to change pressure of when the transport section makes contact with the medium by controlling the position change section; and a post-processing section configured to perform post-processing on the medium on the processing tray, wherein the controller changes the pressure based on processing information regarding processing to be performed on the medium, the processing information includes humidity information regarding humidity, and when the humidity is equal to or higher than a humidity threshold value, the controller lowers the pressure than the pressure of when the humidity is lower than the humidity threshold value.

2. The post-processing apparatus according to claim 1, wherein the processing information includes a transport time period from when the recording section records the information on the medium to when the discharge section discharges the medium, and when the transport time is shorter than a transport threshold value, the controller sets the pressure to a first pressure, whereas when the transport time is equal to or longer than the transport threshold value, the controller sets the pressure to a second pressure, where the first pressure is lower than the second pressure.

3. The post-processing apparatus according to claim 1, wherein the processing information includes a total value of a first recording concentration of an upper surface of a first medium mounted on the processing tray and a second recording concentration of a lower surface of a second medium discharged on the processing tray by the discharge section subsequently to the first medium, and when the total value is equal to or higher than a total threshold value, the controller lowers the pressure than the pressure of when the total value is lower than the total threshold value.

4. The post-processing apparatus according to claim 3, wherein the processing information further includes a third recording concentration of an upper surface of the second medium, and in a first case in which the total value is equal to or higher than the total threshold value, and the third recording concentration is equal to or higher than a concentration threshold value, the controller sets the pressure to a first pressure whereas in a second case in which the total value is equal to or higher than the total threshold value, and the third recording concentration is lower than the concentration threshold value, the controller sets the pressure to a second pressure, where the first pressure is lower than the second pressure.

5. The post-processing apparatus according to claim 3, wherein the processing information further includes a third recording concentration of an upper surface of the second medium, and in a third case in which the total value is lower than the total threshold value, and the third recording concentration is equal to or higher than a concentration threshold value, the controller sets the pressure to a third pressure, whereas in a fourth case in which the total value is lower than the total threshold value, and the third recording concentration is lower than the concentration threshold value, the controller sets the pressure to a fourth pressure, where the third pressure is lower than the fourth pressure.

6. The post-processing apparatus according to claim 4, wherein in the first case, the controller sets an alignment time period during which the transport section transports the second medium and aligns an edge of the medium to a first alignment time period, whereas in the second case, the controller sets the alignment time period to a second alignment time, where the first alignment time is longer than the second alignment time.

7. The post-processing apparatus according to claim 5, wherein in the third case, the controller sets an alignment time period during which the transport section transports the second medium to a third alignment time period, and in the fourth case, the controller sets the alignment time period to a fourth alignment time period, where the third alignment time period is longer than the fourth alignment time period.

8. The post-processing apparatus according to claim 1, wherein the post-processing section is configured to perform first processing or second processing on the medium, the processing information includes post-processing information regarding processing to be performed on the medium by the post-processing section, the first processing is staple processing for binding a plurality of mediums with a staple, the second processing is shift processing for shifting a medium on the processing tray, an alignment time period during which the transport section transports the medium at the first processing is longer than an alignment time period during which the transport section transports the medium at the second processing, and when the controller performs the first processing, the controller lowers the pressure than the pressure of when the controller performs the second processing.

9. The post-processing apparatus according to claim 8, wherein the processing information further includes a recording concentration of an upper surface of the medium to be discharged by the discharge section onto the processing tray, and when the post-processing section performs the first processing, and the recording concentration is equal to or higher than a concentration threshold value, the controller sets the pressure to a first pressure, whereas when the post-processing section performs the first processing, and the recording concentration is lower than the concentration threshold value, the controller sets the pressure to a second pressure, where the first pressure is lower than the second pressure.

10. The post-processing apparatus according to claim 8, wherein the processing information further includes a recording concentration of an upper surface of the medium to be discharged by the discharge section onto the processing tray, and when the post-processing section performs the second processing, and the recording concentration is equal to or higher than a concentration threshold value, the controller sets the pressure to a third pressure, whereas when the post-processing section performs the second processing, and the recording concentration is lower than the concentration threshold value, the controller sets the pressure to a fourth pressure, where the third pressure is lower than the fourth pressure.

11. The post-processing apparatus according to claim 1, wherein the processing information includes recording surface information regarding a recorded surface of the medium, when recording is performed on an upper surface of the medium having contact with the transport section, the controller sets the pressure to a first pressure, whereas when recording is not performed on an upper surface of the medium having contact with the transport section, the controller sets the pressure to a second pressure, where the first pressure is lower than the second pressure.

12. A post-processing apparatus comprising:

a discharge section configured to discharge a medium having thereon information recorded by a recording section, the recording section recording the information by discharging liquid;

a processing tray configured to be loaded with the medium discharged by the discharge section;

an edge alignment section disposed on the processing tray and configured to align an edge of the medium;

a transport section having contact with an upper surface of the medium mounted on the processing tray and configured to transport the medium to the edge alignment section;

a position change section configured to change a relative position of the transport section with respect to the processing tray;

a controller configured to change pressure of when the transport section makes contact with the medium by controlling the position change section; and a post-processing section configured to perform post-processing on the medium on the processing tray, wherein the controller changes the pressure based on processing information regarding processing to be performed on the medium, the processing information includes a transport time period from when the recording section records the information on the medium to when the discharge section discharges the medium, and when the transport time is shorter than a transport threshold value, the controller sets the pressure to a first pressure, whereas when the transport time is equal to or longer than the transport threshold value, the controller sets the pressure to a second pressure, where the first pressure is lower than the second pressure.

13. A post-processing apparatus comprising:

a discharge section configured to discharge a medium having thereon information recorded by a recording section, the recording section recording the information by discharging liquid;

a processing tray configured to be loaded with the medium discharged by the discharge section;

an edge alignment section disposed on the processing tray and configured to align an edge of the medium;

a transport section having contact with an upper surface of the medium mounted on the processing tray and configured to transport the medium to the edge alignment section;

a position change section configured to change a relative position of the transport section with respect to the processing tray;

a controller configured to change pressure of when the transport section makes contact with the medium by controlling the position change section; and a post-processing section configured to perform post-processing on the medium on the processing tray, wherein the controller changes the pressure based on processing information regarding processing to be performed on the medium, the processing information includes a total value of a first recording concentration of an upper surface of a first medium mounted on the processing tray and a second recording concentration of a lower surface of a second medium discharged on the processing tray by the discharge section subsequently to the first medium, and when the total value is equal to or higher than a total threshold value, the controller lowers the pressure than the pressure of when the total value is lower than the total threshold value.

* * * * *